US007032850B2

(12) United States Patent
Fukui

(10) Patent No.: US 7,032,850 B2
(45) Date of Patent: Apr. 25, 2006

(54) USED-CAN PROCESSING SYSTEM AND METHOD

(75) Inventor: Mitsugu Fukui, Kitakyushu (JP)

(73) Assignees: Nissei Kogyo Co., Ltd., Shizuoka-ken (JP); Kensuke Kawakubo, Aichi-ken (JP)

( * ) Notice: Subject to any disclaimer, the term of this patent is extended or adjusted under 35 U.S.C. 154(b) by 59 days.

(21) Appl. No.: 10/770,879

(22) Filed: Feb. 2, 2004

(65) Prior Publication Data

US 2004/0155133 A1 Aug. 12, 2004

(30) Foreign Application Priority Data

Feb. 5, 2003 (JP) ..... 2003-028453
Mar. 25, 2003 (JP) ..... 2003-082938

(51) Int. Cl.
*B02C 18/22* (2006.01)
*B02C 13/00* (2006.01)
*B02C 17/02* (2006.01)

(52) U.S. Cl. ..... 241/73; 241/159; 241/235; 241/236

(58) Field of Classification Search ..... 241/73, 241/159, 235, 236
See application file for complete search history.

(56) References Cited

U.S. PATENT DOCUMENTS 3,462,088 A * 8/1969 Ionescu ..... 241/185.5
5,199,666 A * 4/1993 Williams ..... 241/73
5,451,033 A * 9/1995 Perry et al. ..... 266/145
5,609,307 A * 3/1997 Rota ..... 241/73

FOREIGN PATENT DOCUMENTS

JP 10-57928 3/1998

* cited by examiner

*Primary Examiner*—Derris H. Banks
*Assistant Examiner*—Jason Y. Pahng
(74) *Attorney, Agent, or Firm*—Fish & Richardson P.C.

(57) ABSTRACT

A used-can processing system includes a shredder for cutting a used drum can, and a pelletizer for pelletizing cut pieces of the used can. The shredder includes a pair of rotary blade units which rotate with their blades meshing each other so as to cut a used drum can thrown from above the shredder, and a pair of auxiliary rotary blade units which face the respective rotary blade units and rotate in the same direction as do the corresponding rotary blade units, to thereby urge the used drum can toward the pair of rotary blade units. Each of the blades of the rotary blade units and the auxiliary rotary blade units has projecting portions and depressed portions formed alternately along the circumferential direction. Moreover, a screen having cut-pieces removal holes is disposed below and along the pair of rotary blade units and the pair of auxiliary rotary blade units.

12 Claims, 7 Drawing Sheets

USED-CAN PROCESSING SYSTEM AND METHOD

BACKGROUND OF THE INVENTION

1. Field of the Invention

The present invention relates to a used-can processing system and method for pelletizing used cans for reuse.

2. Description of the Related Art

Conventionally, drum cans formed of steel material have been used for accommodating, for example, liquid or solid waste for the purpose of storage or transportation. After use, such drum cans have been recycled after removal of contamination and impurities such as paint. Such removal of impurities and dirt has been performed by a method in which drum cans are washed by use of cleaning liquid, or a method in which abrasive is blasted to a surface to be treated. Therefore, after being used and subjected to impurity removal processing three times or so, drum cans become unusable because of decreased wall thickness.

In general, used drum cans are scrapped. Also, there has been proposed pelletization of used drum cans at a waste treatment plant and using the thus-produced pellets as a new material (see, for example, Japanese Patent Application Laid-Open (kokai) No. 10-57928. In the proposed recycling process, drum cans are cut into small pieces by use of a shredder, and the thus-produced small pieces are formed into granular pellets by use of a pelletizer.

However, the above-described conventional apparatus has a problem in that a used can such as drum can is difficult to catch by means of blade portions of the shredder, and therefore, cutting of the used can is not easy. Further, since producing cut pieces of uniform size is difficult, pellets produced by a pelletizer vary in size, whereby the commercial value of the thus-produced pellets decreases. Moreover, when a pelletizer is used to produce pellets of uniform size from cut pieces of varying sizes, the pelletizer requires a long time to complete the pelletization process, and therefore fails to perform an efficient pelletization process.

SUMMARY OF THE INVENTION

The present invention has been accomplished in view of the above-mentioned problem, and an object of the present invention is to provide a used-can processing system and method which can cut used cans effectively, and which can render the sizes of cut pieces and pellets uniform.

In order to achieve the above object, the present invention provides a used-can processing system comprising a shredder for cutting a used can, and a pelletizer for pelletizing cut pieces of the used can produced by the shredder, wherein the shredder comprises: a pair of rotary blade units disposed such that their circumferential surfaces having blades formed thereon face each other, the rotary blade units rotating in opposite directions, whereby the circumferential surfaces of the rotary blade units move downward in a facing region where the circumferential surfaces face each other, to thereby cut a used can thrown from above the facing region and feed the cut can downward; and a pair of auxiliary rotary blade units disposed on the upper side of the respective rotary blade units such that their circumferential surfaces having blades formed thereon face the circumferential surfaces of the respective rotary blade units in regions outside the facing region, each of the auxiliary rotary blade units rotating in the same direction as does the corresponding rotary blade unit, to thereby urge, toward the pair of rotary blade units, the used can thrown from above the pair of rotary blade units.

In the used-can processing system according to the present invention, the shredder for cutting a used can includes a pair of rotary blade units, and a pair of auxiliary rotary blade units for urging the used can toward the pair of rotary blade units. The pair of rotary blade units rotate in opposite directions, whereby the circumferential surfaces of the rotary blade units move downward in a facing region where the circumferential surfaces face each other, to thereby cut a used can thrown from above the facing region and feed the cut can downward. Further, each of the pair of auxiliary rotary blade units rotates in the same direction as does the corresponding rotary blade unit, to thereby urge the thrown-in used can toward the pair of rotary blade units. Therefore, a used can thrown from above is first caught by the auxiliary rotary blade units, and then cut by the rotary blade units. Accordingly, a used can can be cut efficiently within a shortened period of time.

Preferably, each of the blades of the rotary blade units and the auxiliary rotary blade units has projecting portions and depressed portions formed alternately along the circumferential direction on the circumferential surface of the corresponding blade. In this case, a used can is caught by the auxiliary rotary blade units under a condition such that the can is nipped from both sides by means of the projecting portions of the auxiliary rotary blade units, and is dragged toward the pair of rotary blade units. Subsequently, the can is nipped between the projecting portions of the pair of rotary blade units rotating in directions opposite each other, so that the can is cut with ease by mean of shearing forces of the projecting portions. According, the catching and cutting of an used can can be performed effectively.

Preferably, a screen having cut-pieces removal holes is disposed below and along the pair of rotary blade units and the pair of auxiliary rotary blade units, whereby cut pieces of the used can that have been cut by means of the pair of rotary blade units and the pair of auxiliary rotary blade units and having sizes less than a predetermined size are fed downward through the cut-pieces removal holes, and cut pieces having sizes not less than the predetermined size are guided and fed to regions above the pair of rotary blade units by means of rotation of the pair of rotary blade units and the pair of auxiliary rotary blade units.

In the used-can processing system configured as described above, a screen having cut-pieces removal holes is disposed below and along the pair of rotary blade units and the pair of auxiliary rotary blade units. Therefore, of cut pieces produced by the pair of rotary blade units and fed downward, only cut pieces smaller than the predetermined size fall downward through the cut-piece removal holes, whereas cut pieces not smaller than the predetermined size are prevented by the screen from falling, and are fed toward the regions above the pair of rotary blade units while following rotation of the pair of rotary blade units and the pair of auxiliary rotary blade units.

Such cut pieces are again dragged into the facing region between the pair of rotary blade units, and are cut. This cutting operation is repeated until all cut pieces become smaller than the predetermined size and pass through the cut-piece removal holes. Cut pieces cut to the predetermined size are pelletized by means of a pelletizer. The thus-produced pellets have a generally uniform size. Since cut pieces are produced to have a predetermined size, processing by the pelletizer can be performed efficiently.

Preferably, the pelletizer includes a chamber provided with a screen having a pellet removal hole through which pellets having a predetermined size or less pass; and a rotary body disposed within the chamber and having a hammer formed on a circumferential surface of the rotary body, the rotary body deforming cut pieces fed into the chamber to pellets by applying impact to the cut pieces by means of the hammer. By virtue of this configuration, pellets can have a uniform size.

Preferably, a heating apparatus is provided so as to heat cut pieces having sizes less than the predetermined size. In this case, when a used can has a paint layer on the surface or contains a residual material, these impurities can be removed from cut pieces of the can through burning of the impurities. Therefore, impurity-free pellets can be obtained even from a used can including impurities such as paint.

Moreover, the present invention provides a used-can processing method comprising a cutting step of cutting a used can; a sorting step of sorting cut pieces of the used can produced in the cutting step into cut pieces smaller than a predetermined size and cut pieces not smaller than the predetermined size; a re-cutting step of again cutting the cut pieces not smaller than the predetermined size; and a pelletization step of pelletizing cut pieces smaller than the predetermined size produced in the cutting step and the re-cutting step.

The used-can processing method of the present invention includes a sorting step in which cut pieces are sorted according to size into two groups of cut pieces; i.e., cut pieces smaller than a predetermined size and cut pieces not smaller than the predetermined size. Further, the step of cutting a used can includes a cutting step of first cutting a used can, and a re-cutting step of again cutting cut pieces not smaller than the predetermined size. Therefore, all cut pieces fed to a pelletization step have sizes smaller than the predetermined size. Therefore, in the pelletization step, the recycled material is easily formed into pellets of a generally uniform size through short time processing.

Preferably, a heating step is provided so as to heat cut pieces produced in the cutting step or the re-cutting step and having the predetermined size. In this case, used cans whose surfaces are painted or which contain residual substance adhering to their inner wall surfaces can be processed properly. That is, paint and residual substance can be burned for removal by a heating process, whereby impurity-free pellets can be obtained.

In this case, the used-can processing method may include a sorting step of sorting cut pieces produced in the cutting step or the re-cutting step and having the predetermined size into two groups of cut pieces; i.e., cut pieces including impurities, and cut pieces not including impurities, wherein only the cut pieces including impurities are fed to the heating step. Further, the pelletization step may include a removing step of removing pellets pelletized to a predetermined size.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

Figure 1:
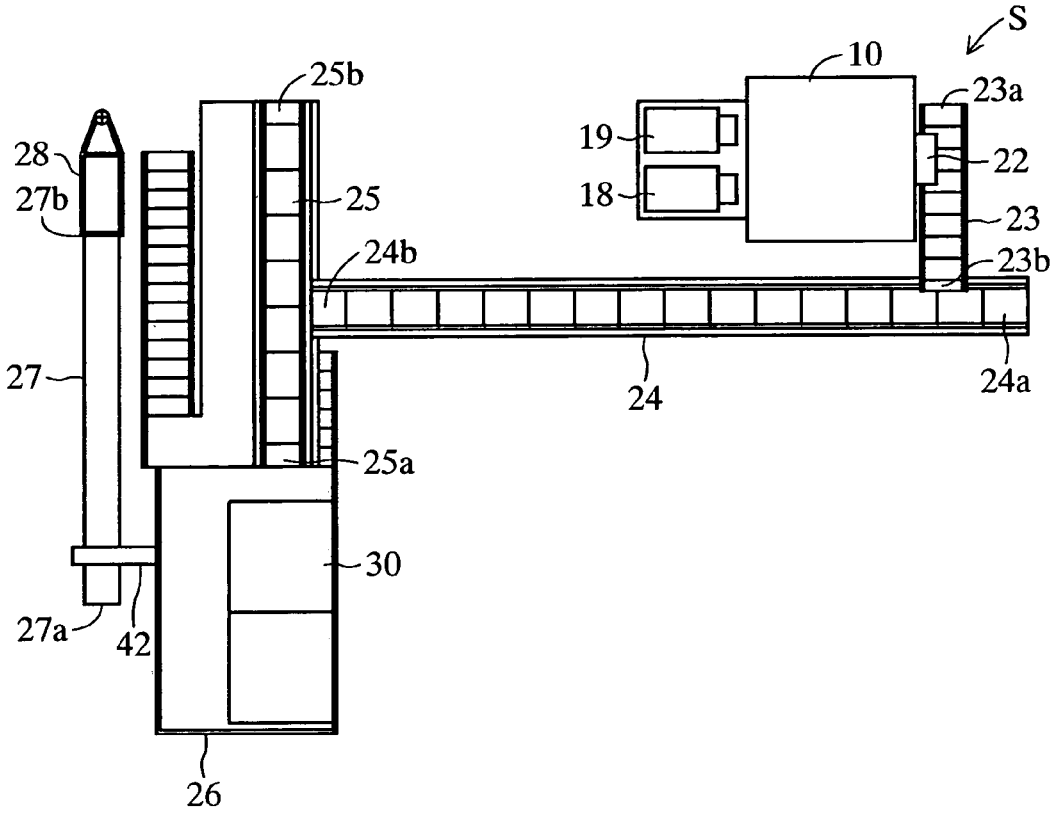
FIG. 1 is a schematic plan view of a used-can processing system according to an embodiment of the present invention.

An embodiment of a used-can processing system according to the present invention will next be described with reference to the drawings. FIGS. 1 to 4 each show the entirety or a portion of the used-can processing system S according to the embodiment. The used-can processing system S is a processing system for recycling used drum cans D (see FIG. 8) having been used for accommodating liquid or solid for the purpose of storage or transportation, to thereby produce pellets of steel material. The used-can processing system S consists of various apparatuses, including a shredder 10 and a pelletizer 30.

The shredder 10 is configured as shown in FIGS. 5 to 8. Specifically, the shredder 10 includes a base portion 11 having a leg portion 11*a* and a cutting chamber 11*b*. Paired rotary blade units 12 and 13, paired auxiliary rotary blade units 14 and 15, and a screen 16 are disposed within the cutting chamber 11*b*, and a hopper 17 is provided above the cutting chamber 11*b*. A motor 18 for rotating the rotary blade unit 12 and the auxiliary rotary blade unit 14 is connected to the auxiliary rotary blade unit 14 via a rotary shaft 18*a*, whereas a motor 19 for rotating the rotary blade unit 13 and the auxiliary rotary blade unit 15 is connected to the auxiliary rotary blade unit 15 via a rotary shaft 19*a*.

The rotary blade unit 12 includes a plurality of blades 12*c* having a generally disc-like shape and disposed on a shaft 12*d* at equal intervals along the axial direction. Each of the blades 12*c* has projecting portions 12*a* and recessed portions 12*b* along the circumferential surface thereof. The intervals of the blades 12*c* are set slightly greater than the thickness of the blades 12*c*. The rotary blade unit 13 has a structure substantially identical to that of the rotary blade unit 12. That is, the rotary blade unit 13 includes a plurality of blades 13*c* having a generally disc-like shape and disposed on a shaft 13*d* at equal intervals along the axial direction. Each of the blades 13*c* has projecting portions 13*a* and recessed portions 13*b* along the circumferential surface thereof. The paired rotary blade units 12 and 13 are mounted to extend horizontally in such a manner that their outer circumferential surfaces face each other and that a peripheral portion of each blade 13*c* is inserted between two adjacent blades 12*c*, and a peripheral portion of each blade 12*c* is inserted between two adjacent blades 13*c*, whereby the blades 12*c* and the blades 13*c* are alternately disposed or meshed together.

The paired auxiliary rotary blade units 14 and 15 have a structure substantially identical to that of the rotary blade units 12 and 13. That is, the auxiliary rotary blade unit 14 includes a plurality of blades 14*c* each having projecting portions 14*a* and recessed portions 14*b* along the circumferential surface thereof, and a shaft 14*d* to which the blades

14*c* are mounted. The auxiliary rotary blade unit 15 includes a plurality of blades 15*c* each having projecting portions 15*a* and recessed portions 15*b* along the circumferential surface thereof, and a shaft 15*d* to which the blades 15*c* are mounted. The auxiliary rotary blade unit 14 is mounted on the upper left of the rotary blade unit 12 in FIG. 7 in such a manner that the outer circumferential surface of the auxiliary rotary blade unit 14 faces the outer circumferential surface of the rotary blade unit 12 and that the blades 14*c* and the blades 12*c* are alternately disposed. Further, the auxiliary rotary blade unit 15 is mounted on the upper right of the rotary blade unit 13 in FIG. 7 in such a manner that the outer circumferential surface of the auxiliary rotary blade unit 15 faces the outer circumferential surface of the rotary blade unit 13 and that the blades 15*c* and the blades 13*c* are alternately disposed.

The shaft 14*d* is connected to the rotary shaft 18*a*, and therefore the auxiliary rotary blade unit 14 rotates when the motor 18 is operated. The auxiliary rotary blade unit 14 and the rotary blade unit 12 are connected together by means of an unillustrated power transmission mechanism in such a manner that the auxiliary rotary blade unit 14 and the rotary blade unit 12 rotate in a synchronized condition. Therefore, when the motor 18 is operated, the rotary blade unit 12 rotates in the same direction as the auxiliary rotary blade unit 14. Similarly, the shaft 15*d* is connected to the rotary shaft 19*a*, and therefore the auxiliary rotary blade unit 15 rotates when the motor 19 is operated. The auxiliary rotary blade unit 15 and the rotary blade unit 13 are connected together by means of an unillustrated power transmission mechanism in such a manner that the auxiliary rotary blade unit 15 and the rotary blade unit 13 rotate in a synchronized condition. Therefore, when the motor 19 is operated, the rotary blade unit 13 rotates in the same direction as the auxiliary rotary blade unit 15.

Figure 7:
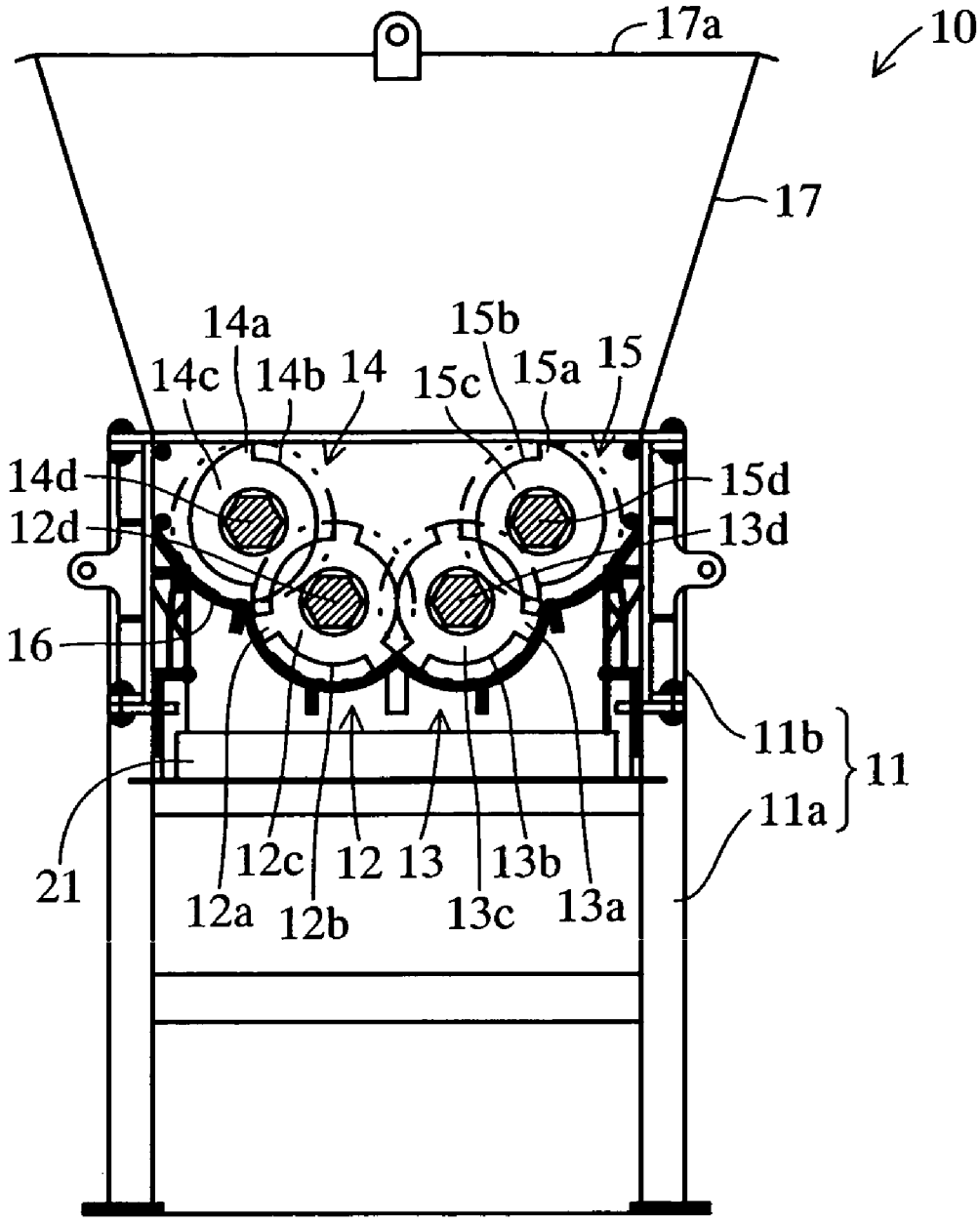
FIG. 7 is a side view of the shredder.
Figure 8:
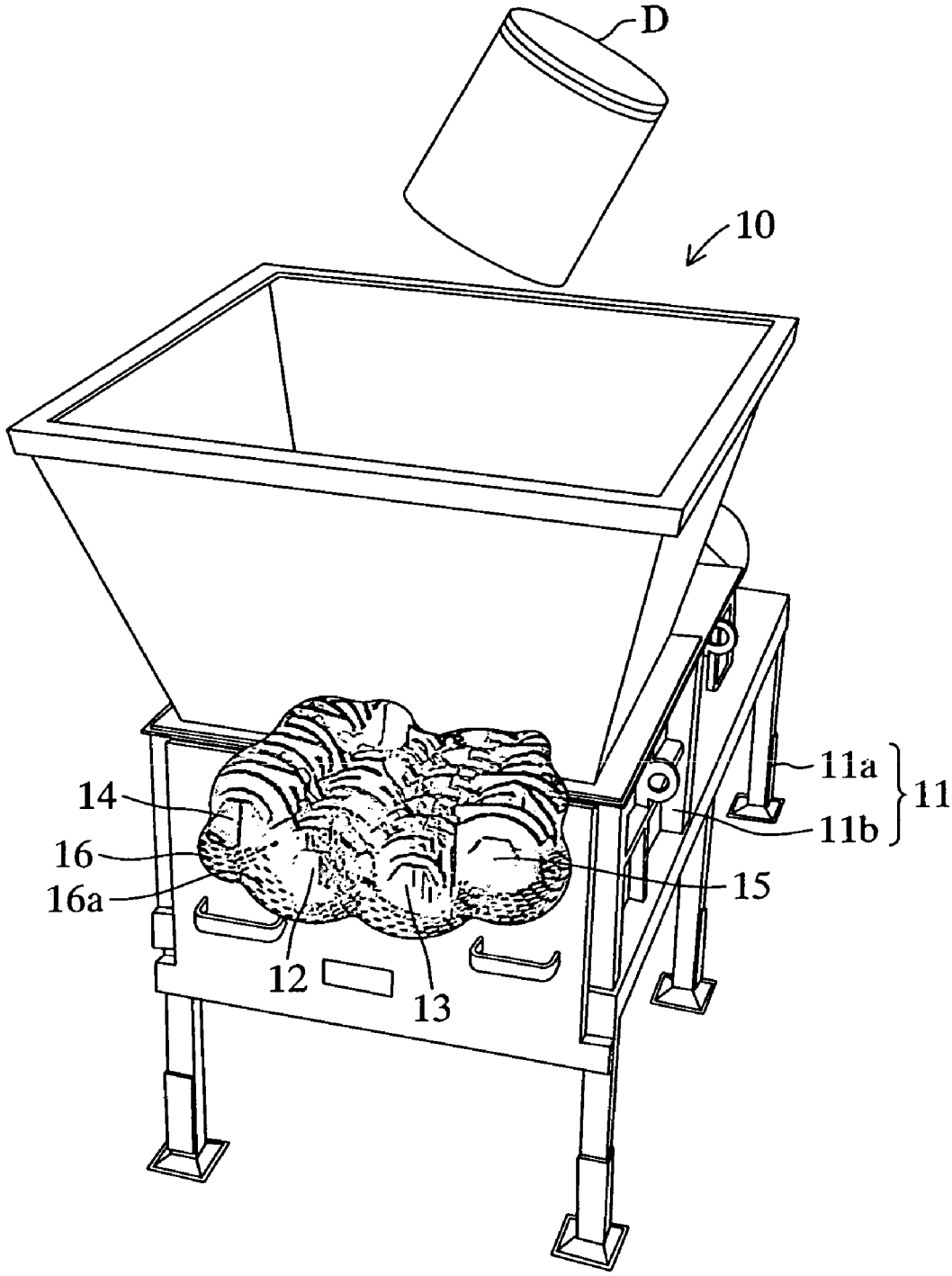
FIG. 8 is a perspective view of the shredder.

As shown in FIGS. 7 and 8, the screen 16 is a curved plate member extending along lower surfaces of the paired rotary blade units 12 and 13 and the paired auxiliary rotary blade units 14 and 15. A plurality of removal holes 16*a* of uniform size and serving as cut-piece removal holes of the present invention are formed over the entire screen 16. The size of the removal holes 16*a* is set in accordance with the size of pellets to be produced by the pelletizer 30. The removal holes 16*a* allow passage of cut pieces smaller than a predetermined size. The hopper 17 assumes a rectangular tubular shape such that an upper end opening portion 17*a* of the hopper is wider than a lower end opening portion thereof. The lower end opening portion communicates with an upper end opening portion of the cutting chamber 11*b*.

Therefore, when a drum can D is thrown in the hopper 17 with the motors 18 and 19 being operated, the drum can D is caught by the paired auxiliary rotary blade units 14 and 15, and is dragged toward a central region of the cutting chamber 11*b*. Further, the drum can D is nipped by the paired rotary blade units 12 and 13 and passes between their facing surfaces. During the passage, the drum can D is cut by means of shearing forces of the projecting portions 12*a* and 13*a*. Cut pieces (not shown) smaller than a predetermined size pass through the removal holes 16*a* and fall down from the screen 16. Cut pieces larger than the predetermined size are conveyed upward along the screen 16 by means of the projecting portions 12*a*, 13*a*, 14*a*, and 15*a*. The conveyed cut pieces are cut again by the paired rotary blade units 12 and 13. This cutting operation is repeated until the cut pieces become smaller than the predetermined size.

Figure 2:
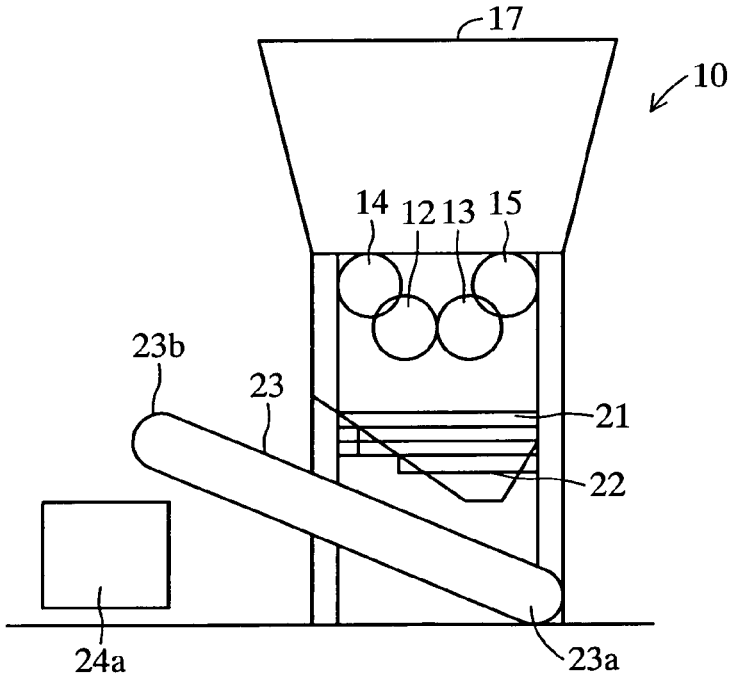
FIG. 2 is a schematic side view of a shredder used in the used-can processing system shown in FIG. 1.

A vibration feeder 21 is provided at a lower end portion of the cutting chamber 11*b*, and when the vibration feeder 21 is operated, the shredder 10 vibrates. By virtue of this vibration, cut pieces produced by the shredder 10 effectively pass through the removal holes 16*a* of the screen 16. Moreover, a removal opening 22 is provided in a lower end portion of one side wall of the cutting chamber 11*b*; and as shown in FIG. 2, a lower end portion 23*a* of an inclined conveyer 23 is positioned below the removal opening 22.

Figure 3:
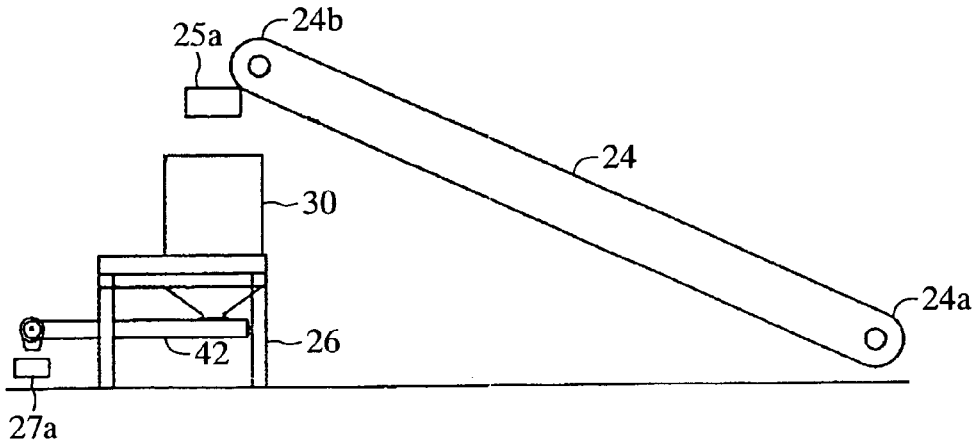
FIG. 3 is a schematic front view of conveyers used in the used-can processing system shown in FIG. 1.
Figure 4:
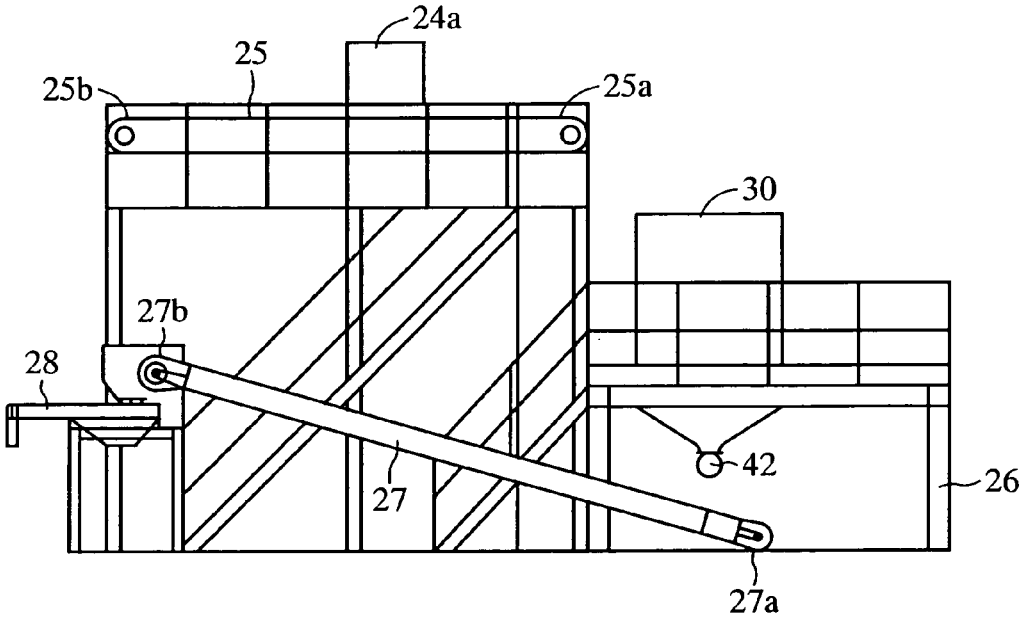
FIG. 4 is a schematic side view of a pelletizer used in the used-can processing system shown in FIG. 1.
Figure 5:
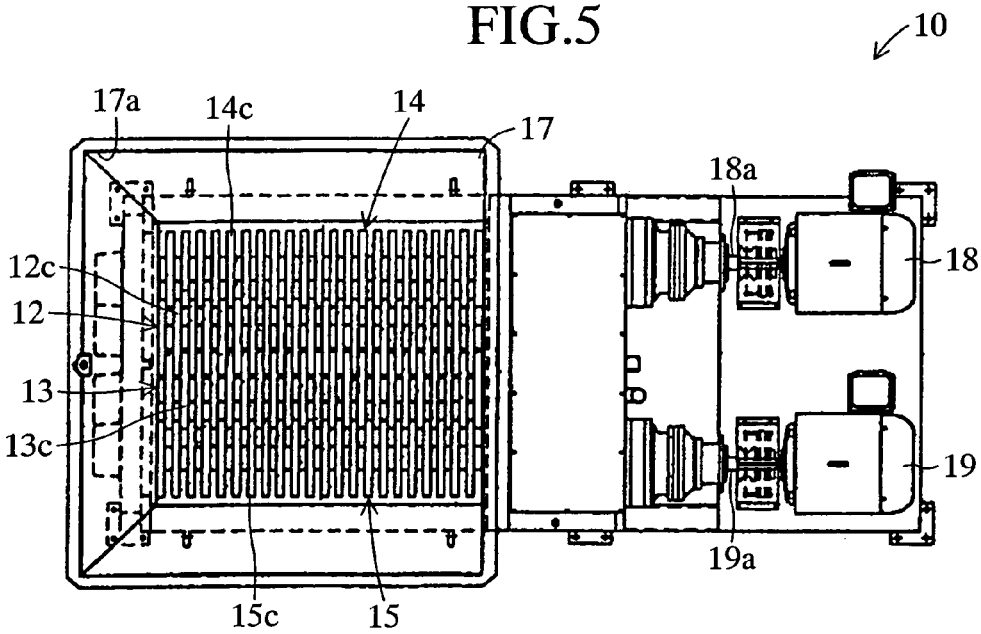
FIG. 5 is a plan view of the shredder.
Figure 6:
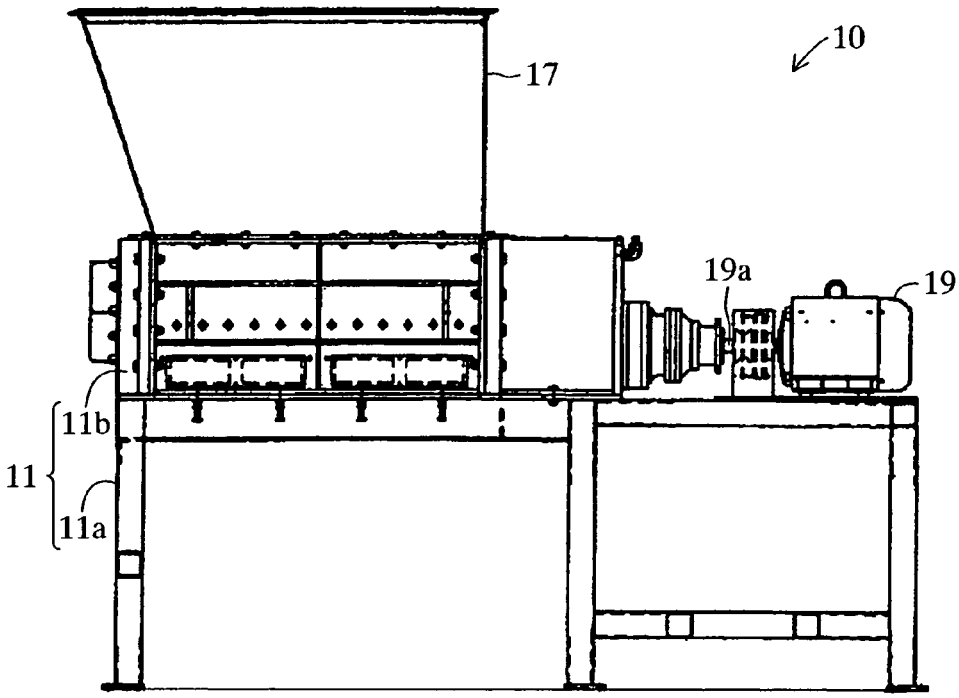
FIG. 6 is a front view of the shredder.

A lower end portion 24*a* of a finned conveyer 24, which is disposed in an inclined position as shown in FIG. 3, is positioned below an upper end portion 23*b* of the conveyer 23. An approximately central portion of a forward/reverse conveyer 25, which is disposed to extend horizontally as shown in FIG. 4, is positioned below an upper end portion 24*b* of the finned conveyer 24. Cut pieces removed from the shredder 10 via the removal opening 22 are conveyed to the forward/reverse conveyer 25 by means of the conveyer 23 and the finned conveyer 24, and then transported to one end portion (first end portion) 25*a* or the other end portion (second end portion) 25*b* of the forward/reverse conveyer 25. The forward/reverse conveyer 25 is configured such that the conveyance direction can be switched between the direction toward the first end portion 25*a* and the direction toward the second end portion 25*b*. The forward/reverse conveyer 25 conveys cut pieces not containing impurities to the first end portion 25*a*, and conveys cut pieces containing impurities to the second end portion 25*b*.

Figure 9:
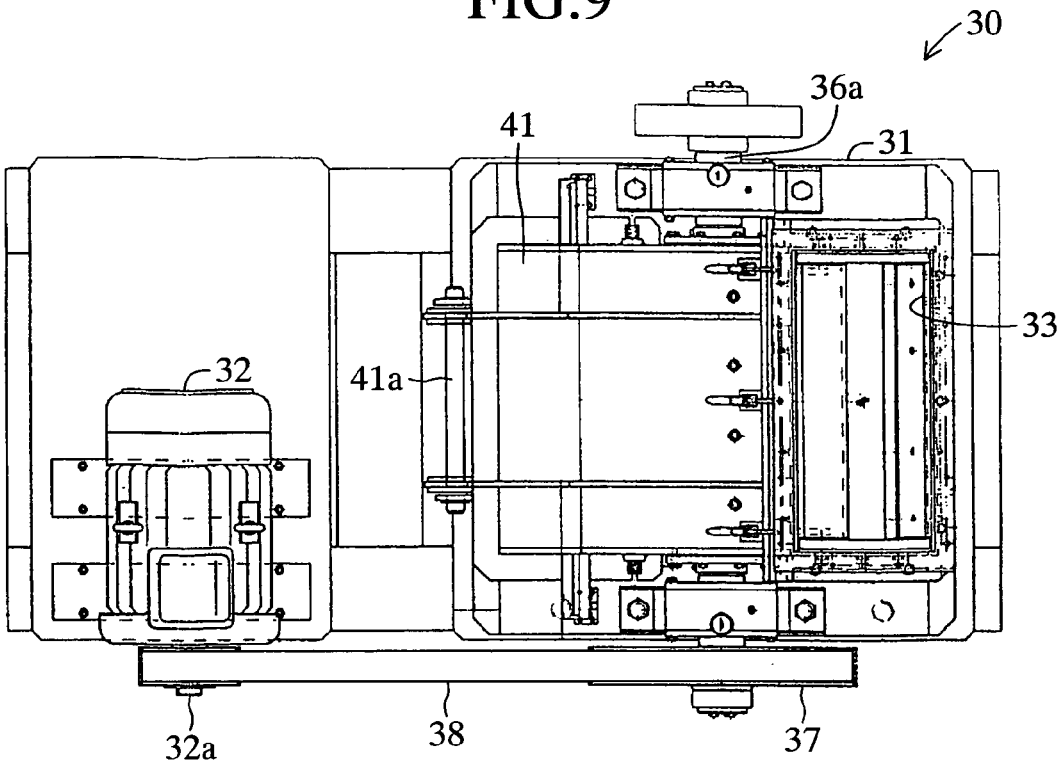
FIG. 9 is a plan view of the pelletizer.
Figure 10:
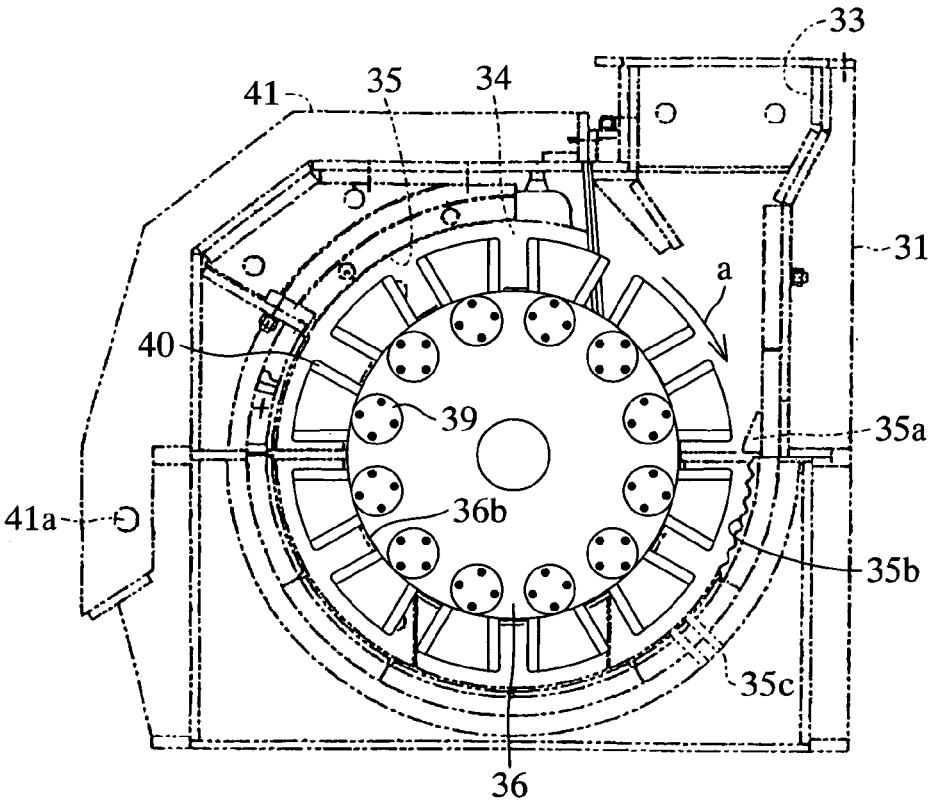
FIG. 10 is a side view of the pelletizer, showing a pelletizing chamber of the pelletizer.

The pelletizer 30 is disposed below the first end portion 25*a* of the forward/reverse conveyer 25. The pelletizer 30 is disposed on the top wall of a base 26, and is configured as shown in FIGS. 9 and 10. The pelletizer 30 includes a pelletizing chamber 31 and a motor 32. A receiving opening 33 for receiving cut pieces is formed at one end of the top wall of the pelletizing chamber 31. A general cylindrical space section 34 is formed within the pelletizing chamber 31 in such a manner that the center axis of the cylindrical space section 34 extends horizontally. A cutting line 35*a* formed of a projection is provided on a circumferential wall portion 35 of the cylindrical space section 34 to be located below the receiving opening 33 and to extend horizontally.

Further, a vertically-extending corrugated surface 35*b* is formed on the circumferential wall portion 35 to be located below the cutting line 35*a*. Further, a screen is provided under the circumferential wall portion 35, and removal holes 35*c* serving as pellet removal holes for removing pellets of a predetermined shape are formed in the screen. Moreover, a rotary body 36 rotatably supported by a shaft 36*a* is disposed within the cylindrical space section 34 of the pelletizing chamber 31. The rotary body 36 is connected to a rotary shaft 32*a* of the motor 32 via a belt 38 and a pulley 37 attached to one end of the shaft 36*a*, and rotates when the motor 32 is operated.

A plurality of circumferentially-extending attachment members 36*b* are provided on the circumferential surface of the rotary body 36 at equal axial intervals; and pins 39 are attached between adjacent attachment members 36*b* at predetermined locations. A hammer 40 is attached to each pin 39. Arrow A indicates the rotation direction of the rotary body 36. An opening is formed at the other end of the top wall of the pelletizing chamber 31. A cover 41 for opening and closing the opening is swingably attached to a shaft 41*a* provided on a side portion of the pelletizing chamber 31.

A removal duct 42 is provided at a lower end of the pelletizing chamber 31; and a lower end portion 27*a* of a product conveyer 27, which is disposed in an inclined position as shown in FIG. 4, is positioned below an end portion of the removal duct 42. A dust removing screen 28 is disposed below an upper end portion 27*b* of the product conveyer 27. The dust removing screen 28 is formed by a filter, and removes dust from pellets conveyed from the removal duct 42 of the pelletizing chamber 31 by means of the product conveyer 27, whereby the dust-removed pellets are obtained as products.

Figure 11:
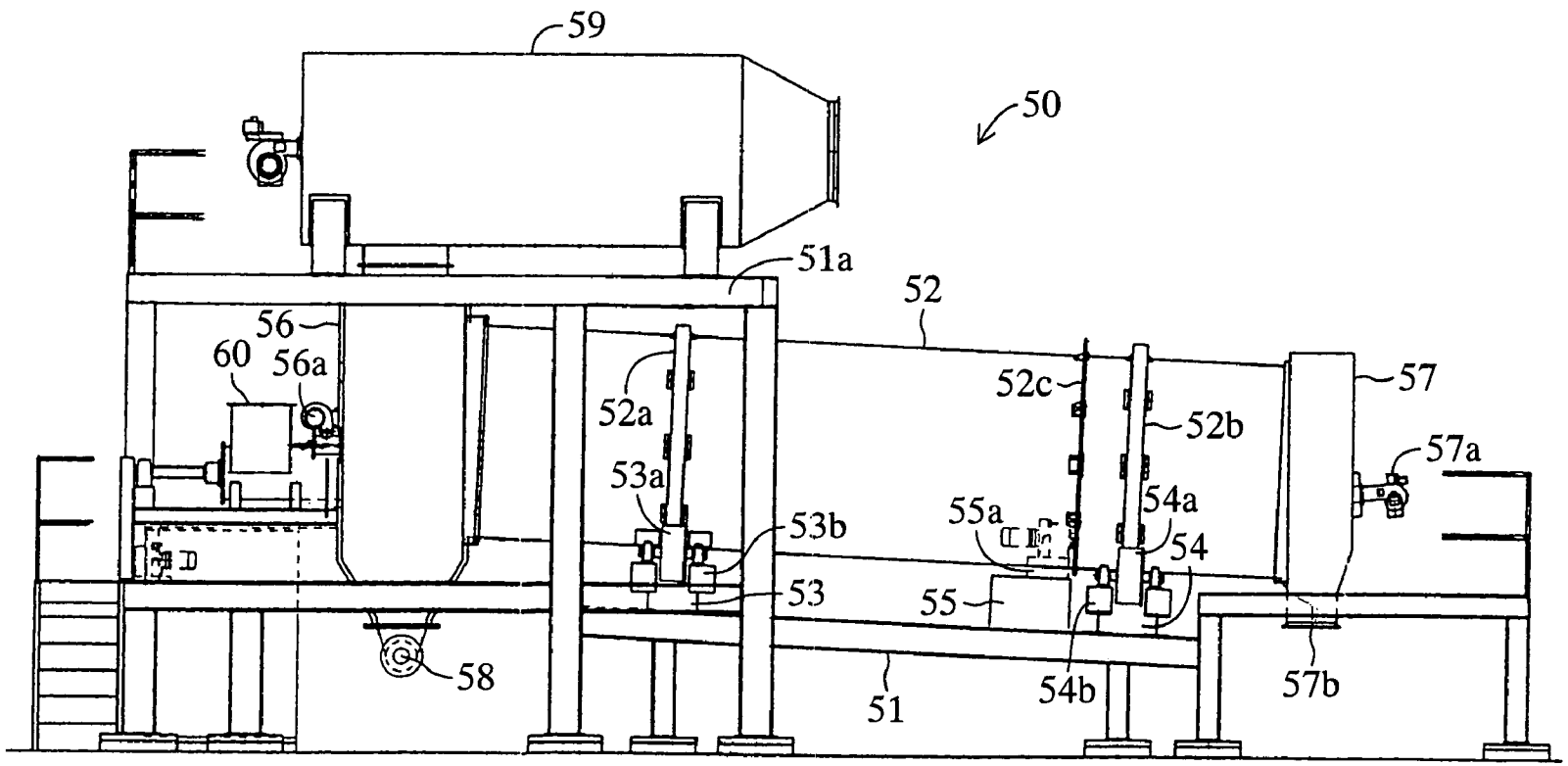
FIG. 11 is a front view of a rotary kiln.

In contrast, impurity-containing cut pieces conveyed to the second end portion 25*b* of the forward/reverse conveyer 25 are transported from the second end portion 25*b* to a rotary kiln 50, which is shown in FIG. 11 and which serves as the heating apparatus of the present invention. The rotary kiln 50 includes a rotary, tubular member 52 disposed on a platform 51; a pair of guides 53 and 54 which support the rotary, tubular member 52 such that the rotary, tubular member 52 can rotate about its axis; a drive unit 55 for rotating the rotary, tubular member 52; a fore kiln 56; and an aft kiln 57.

The rotary, tubular member 52 has flange-like guide protrusions 52*a* and 52*b* formed on its outer circumferential surface at upstream and downstream portions, respectively, thereof. The rotary, tubular member 52 also has a flange-like engagement protrusion 52*c* formed on the outer circumferential surface between the guide protrusions 52*a* and 52*b* and in the vicinity of the guide protrusion 52*b*. The engagement protrusion 52*c* is engaged with a drive section 55*a* of the drive unit 55. The paired guides 53 and 54 are disposed on the ton surface of the platform 51 at upstream and downstream positions, respectively, and support the rotary, tubular member 52 such that the downstream end of the rotary, tubular member 52 is situated lower than the upstream end of the same. The guide 53 (54) has a plurality of rollers 53*a* (54*a*) arranged at predetermined intervals along the circumferential surface of the guide protrusion 52*a* (52*b*), and a support 53*b* (54*b*) that supports the rollers 53*a* (54*a*) rotatably.

The drive unit 55 is disposed on the top surface of the platform 51 in the vicinity of the engagement protrusion 52*c*, while the drive section 55*a* is engaged with the engagement protrusion 52*c*. Thus, when the drive unit 55 is activated, the rotary, tubular member 52 rotates about its axis while being guided by means of the guides 53 and 54 in such a manner that the circumferential surface of the guide protrusion 52*a* (52*b*) is in contact with the circumferential surfaces of the rollers 53*a* (54*a*) of the guide 53 (54).

The fore kiln 56 is disposed on an upstream portion of the platform 51 in such a manner as to close the upstream opening of the rotary, tubular member 52. A burner 56*a* is provided on the upstream end panel of the fore kiln 56 at a substantially central position while being directed toward the center axis of the rotary, tubular member 52. Flames of this burner 56*a* heat cut pieces which are conveyed into the rotary, tubular member 52. A bottom portion of the fore kiln 56 is connected to a dust conveyor 58, whereas a top portion of the fore kiln 56 is connected to an afterburning kiln 59 disposed on an upper level platform 51*a* provided above the upstream portion of the platform 51.

The dust conveyor 58 conveys to the exterior of the system carbonized substances and dust which are generated within the fore kiln 56 and the rotary, tubular member 52 as a result of firing. The afterburning kiln 59 heats exhaust gas generated within the fore kiln 56 and the rotary, tubular member 52, and sends the heated exhaust gas to an exhaust gas filtering apparatus (not shown). The exhaust gas filtering apparatus filters the exhaust gas before release to the exterior of the system. The aft kiln 57 is disposed on a downstream portion of the platform 51 in such a manner as to close the downstream opening of the rotary, tubular member 52. A burner 57*a* is provided on the downstream end panel of the aft kiln 57 at a central position while being directed toward the center axis of the rotary, tubular member 52. Flames of this burner 57*a* heat cut pieces which are conveyed within the rotary, tubular member 52.

A charging chute 60 is formed on the upstream side of the fore kiln 56. The charging chute 60 receives cut pieces conveyed via the forward/reverse conveyer 25 and introduces them into the fore kiln 56. An opening portion at the upper end of the chute is widened as compared with the remaining portion. A control console (not shown) is disposed in the vicinity of the platform 51. The control console includes a control unit for controlling the used-can processing system S, and an operation panel for operating the used-can processing system S.

The thus-configured used-can processing system S recycles used drum cans D in the following manner. First, an operator operates on the control console so as to activate the apparatuses provided in the used-can processing system S. As a result, in the shredder 10, the motors 18 and 19 operate, whereby the rotary blade unit 12 and the auxiliary rotary blade unit 14 rotate in the clockwise direction in FIG. 7, and the rotary blade unit 13 and the auxiliary rotary blade unit 15 rotate in the counterclockwise direction in FIG. 7. When a drum can D is thrown in the hopper 17 in this state, the drum can D first comes into contact with the paired auxiliary rotary blade units 14 and 15, and is caught by the projecting portions 14*a* and 15*a* thereof. As a result, the drum can D is dragged toward the paired rotary blade units 12 and 13 while being deformed.

When a tip portion of the drum can D comes into contact with the paired rotary blade units 12 and 13, the drum can D is gradually nipped by the paired rotary blade units 12 and 13 and passes between their facing surfaces. During the passage, the drum can D is cut in zigzag fashion by means of shearing forces of the projecting portions 12*a* and 13*a* of the alternately disposed blades 12*c* and 13*c*. Cut pieces smaller than a predetermined size pass through the removal holes 16*a* and fall down from the screen 16. At this time, the cut pieces can quickly pass through the removal holes 16*a*, because the shredder 10 is caused to vibrate by the vibration feeder 21.

Cut pieces larger than the predetermined size are conveyed upward along the screen 16 through engagement with the projecting portions 12*a* and 13*a* of the rotating rotary blade units 12 and 13 and the projecting portions 14*a* and 15*a* the rotating auxiliary rotary blade units 14 and 15. The thus-conveyed cut pieces are conveyed from regions above the auxiliary rotary blade units 14 and 15 toward the rotary blade units 12 and 13, and are cut by means of the rotary blade units 12 and 13. This cutting operation is repeated until the cut pieces become smaller than the predetermined size.

Cut pieces whose sizes have been reduced to the predetermined size successively fall from the removal opening 22 onto the lower end portion 23*a* of the conveyer 23, and are then conveyed to the central portion of the forward/reverse conveyer 25 by means of the conveyer 23 and the finned conveyer 24. When the cut drum can D does not contain impurities such as paint and residual substance, the forward/reverse conveyer 25 is operated to convey cut pieces toward the first end portion 25*a*. By virtue of this conveyance operation, cut pieces conveyed onto the forward/reverse conveyer 25 fall down from the first end portion 25*a* into the receiving opening 33 of the pelletizer 30.

Cut pieces having entered the receiving opening 33 of the pelletizer 30 are gradually deformed into a granular shape while being struck by the plurality of hammers 40 attached to the rotary body 36, which is rotated by the motor 32.

When cut pieces pass through a region along the cutting line 35*a* on the circumferential wall portion 35, the cut pieces are formed into pellets having a predetermined size, while projecting portions of the cut pieces are chipped by means of tip portions of the hammers 40 and the cutting line 35*a*. When the cut pieces pass through a region along the corrugated surface 35*b*, the cut pieces are processed or machined to have smooth, curved surfaces.

The thus-produced pellets having a predetermined size fall through the removal holes 35*c* into the removal duct 42. The pellets are then conveyed to the dust removing screen 28 by means of the removal duct 42 and the product conveyer 27. On the dust removing screen 28, dust is removed from the pellets conveyed by means of the product conveyer 27, whereby dust-free pellets suitable for use as a steel material are obtained.

When the cut pieces conveyed to the forward/reverse conveyer 25 contain impurities such as paint or residual substance, the forward/reverse conveyer 25 is operated to convey the cut pieces to the second end portion 25*b*. As a result, the cut pieces conveyed to the forward/reverse conveyer 25 fall from the second end portion 25*b* into the charging chute 60 and then into the fore kiln 56. The cut pieces move from the fore kiln 56 into the rotary, tubular member 52, which is rotated by the drive unit 55. The atmospheric temperature within the rotary, tubular member 52 has been elevated to about 400° C. by means of flames of the burners 56*a* and 57*a*.

The cut pieces having entered the rotary, tubular member 52 are conveyed from the upstream end of the rotary, tubular member 52 to the downstream end of the same while being heated by means of flames of the burner 56*a* of the fore kiln 56 and flames of the burner 57*a* of the aft kiln 57. The burners 56*a* and 57*a* are directed toward a central portion of the rotary, tubular member 52 or a portion slightly above the central portion so as to avoid the flames of the burners 56*a* and 57*a* directly impinging on the cut pieces.

Thus, a paint layer and/or residual substance can be removed, through combustion, from the surfaces of the cut pieces without involvement of excessive oxidation of the cut pieces. When temperature within the rotary, tubular member 52 reaches an appropriate temperature of 550° C., preferably, the burners 56*a* and 57*a* are turned off, and the cut pieces are conveyed through the rotary, tubular member 52 while the burners 56*a* and 57*a* remain off. When temperature within the rotary, tubular member 52 drops to, for example, 480° C. or lower, the burners 56*a* and 57*a* may be turned on, whereby an appropriate heating temperature for the cut pieces can be maintained.

Cut pieces which have reached the downstream end of the rotary, tubular member 52 drop through a discharge port 57*b* provided at the bottom portion of the aft kiln 57. After dropping through the discharge port 57*b*, the cut pieces are conveyed to the pelletizer 30 by means of a conveyor (not shown). In the pelletizer 30, the cut pieces are formed into granular pellets through the above-described processing. Carbonized substances and dust generated within the rotary, tubular member 52 are conveyed to the exterior of the system by means of the dust conveyor 58 and treated appropriately. Exhaust gas is sent to the afterburning kiln 59 and burned completely at high temperature through application of heat. The exhaust gas which has undergone afterburning is filtered and released to the exterior of the system.

As described above, according to the used-can processing system S, the shredder 10 for cutting a drum can D mainly includes the paired rotary blade units 12 and 13 for cutting the drum can D, and the paired auxiliary rotary blade units 14 and 15 for urging the drum can D toward the paired rotary blade units 12 and 13. Therefore, a drum can D thrown from the hopper 17 is first caught by the auxiliary rotary blade units 14 and 15, and then cut by the rotary blade units 12 and 13. Accordingly, a drum can D can be cut efficiently within a shorter period of time, as compared with the case where the rotary blade units 12 and 13 directly catch and cut a drum can D.

Since each of the blades 12*c*, etc. of the rotary blade units 12 and 13 and the auxiliary rotary blade units 14 and 15 has the projecting portions 12*a*, etc. and the depressed portions 12*b*, etc. formed alternately along the circumferential direction on the circumferential surface thereof, the catching and cutting of a drum can D can be performed easily and effectively. Further, since the screen 16 having the removal holes 16*a* is disposed in the shredder 10, cut pieces greater than a predetermined size are conveyed to regions above the rotary blade units 12 and 13, and are cut again. As a result, cut pieces leaving the shredder 10 have a generally uniform size, which enables smooth pelletization in the pelletizer 30.

Since the pelletizer 30 includes the hammers 40, the cutting line 35*a*, and the corrugated surface 35*b*, cut pieces are formed into pellets having a predetermined size by means of the hammers 40 and the cutting line 35*a*, and machined to have a smooth curved surface when passing through the region along the corrugated surface 35*b*. Further, the removal holes 35*c* are formed in a lower portion of the circumferential wall portion 35 in order to allow cut pieces having a predetermined size and shape to be removed from the pelletizer 30. The thus-obtained recycled material assumes the form of pellets of substantially uniform size, and has a high commercial value.

The used-can processing system S of the present invention has the rotary kiln 50 for heating cut pieces. Therefore, when a drum can D has a paint layer on the surface or contains a residual material, these impurities can be removed from cut pieces of the drum can D through burning. Therefore, good pellets can be obtained even from a drum can D including impurities such as paint.

The present invention is not limited to the above-described embodiment, but may be modified as appropriate. For example, in the above-described embodiment, the used-can processing system S is used for processing drum cans D. Used cans processed by the used-can processing system S are not limited to drum cans D, and the used-can processing system S of the present invention can process other types of used cans for industrial use or for food use, such as 18 liter cans, gallon cans, tea cans, milk cans, spray cans, aerosol cans, and confectionery cans assuming the shape of a rectangular box. Moreover, cans to be processed may have any shape.

What is claimed is:

1. A used-can processing system comprising a shredder for cutting a used can, and a pelletizer for pelletizing cut pieces of the used can produced by a shredder, wherein the shredder comprises:

a pair of main rotary blade units disposed such that their circumferential surfaces having blades formed thereon face each other, the main rotary blade units rotating in opposite directions, whereby the circumferential surfaces of the main rotary blade units move downward in a facing region where the circumferential surfaces face each other, to thereby cut a used can fed from above the facing region and feed the cut can downward; and a pair of auxiliary rotary blade units disposed on the upper side of the respective main rotary blade unite such that circumferential surfaces of the pair of auxiliary rotary blade units having blades formed thereon face the circumferential surfaces of the respective main rotary blade units in regions outside the facing region, each of the auxiliary rotary blade units rotating in the same direction as does the corresponding main rotary blade unit, to thereby urge, toward the pair of main rotary blade units, the used can thrown from above the pair of main rotary blade units, and wherein the pelletizer includes:

a chamber provided with a receiving opening for receiving cut pieces and a screen having a pellet removal hole through which pellets having a predetermined size or less pass;

a rotary body disposed within the chamber and having a hammer formed on a circumferential surface of the rotary body, the rotary body deforming cut pieces fed into the chamber to pellets by applying impact to the cut pieces by means of the hammer;

a cutting line formed of a projection that is provided on a circumferential wall portion of the chamber to be located below the receiving opening; and a vertically-extending corrugated surface that is formed on the circumferential wall portion to be located below the cutting line.

2. A used-can processing system according to claim 1, wherein each of the blades of the main rotary blade units and the auxiliary rotary blade units has projecting portions and depressed portions formed alternately along the circumferential direction on the circumferential surface of the corresponding blade.

3. A used-can processing system according to claim 1, wherein a screen having cut-piece removal holes is disposed below and along the pair of main rotary blade units and the pair of auxiliary rotary blade units, whereby cut pieces of the used can that have been cut by means of the pair of main rotary blade units and the pair of auxiliary rotary blade unite and having sizes less than a predetermined size are fed downward through the cut-piece removal holes, and cut pieces having sizes not less than the predetermined size are guided and fed to regions above the pair of main rotary blade units by means of rotation of the pair of main rotary blade units and the pair of auxiliary rotary blade units.

4. A used-can processing system according to claim 1, further comprising a heating apparatus for heating cut pieces which are produced as a result of cutting of the used can by means of the main rotary blade units and the auxiliary rotary blade units and which have a predetermined size.

5. A used-can processing system according to claim 2, wherein a screen having cut-pieces removal holes is disposed below and along the pair of main rotary blade units and the pair of auxiliary rotary blade units, whereby cut pieces of the used can that have been cut by means of the pair of main rotary blade units and the pair of auxiliary rotary blade units and having sizes less than a predetermined site are fed downward through the cut-piece removal holes, and cut pieces having sizes not less than the predetermined size are guided and fed to regions above the pair of main rotary blade units by means of rotation of the pair of main rotary blade units and the pair of auxiliary rotary blade units.

6. A used-can processing system according to claim 2, further comprising a heating apparatus for heating cut pieces which are produced as a result of cutting of the used can by means of the main rotary blade units and the auxiliary rotary blade units and which have a predetermined size.

7. A used-can processing system according to claim 3, further Comprising a heating apparatus for heating cut pieces which are produced as a result of cutting of the used can by means of the main rotary blade units and the auxiliary rotary blade units and which have a predetermined size.

8. A used-can processing system according to claim 5, further comprising a heating apparatus for heating cut pieces which are produced as a result of cutting of the used can by means of the main rotary blade units and the auxiliary rotary blade units and which have a predetermined size.

9. A used-can processing system according to claim 4, wherein the heating apparatus is constructed of a rotary kiln that includes a rotary, tubular member; a pair of guides which support the rotary, tubular member such that the rotary, tubular member can rotate about its axis; a drive unit for rotating the rotary, tubular member, a fore kiln; and an aft kiln.

10. A used-can processing system according to claim 6, wherein the heating apparatus is constructed of a rotary kiln that includes a rotary, tubular member; a pair of guides which support the rotary, tubular member such that the rotary, tubular member can rotate about its axis; a drive unit for rotating the rotary, tubular member; a fore kiln; and an aft kiln.

11. A used-can processing system according to claim 7, wherein the heating apparatus is constructed of a rotary kiln that includes a rotary, tubular member; a pair of guides which support the rotary, tubular member such that the rotary, tubular member can rotate about its axis; a drive unit for rotating the rotary, tubular member; a fore kiln; and an aft kiln.

12. A used-can processing system according to claim 8, wherein the heating apparatus is constructed of a rotary kiln that includes a rotary, tubular member; a pair of guides which support the rotary, tubular member such that the rotary, tubular member can rotate about its axis; a drive unit for rotating the rotary, tubular member; a fore kiln; and an aft kiln.

* * * * *